US006786738B2

(12) United States Patent
Lin

(10) Patent No.: US 6,786,738 B2
(45) Date of Patent: Sep. 7, 2004

(54) ELECTRICAL CONTACT FOR LGA SOCKET CONNECTOR

(75) Inventor: Nick Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/283,916

(22) Filed: Oct. 29, 2002

(65) Prior Publication Data

US 2004/0043642 A1 Mar. 4, 2004

(30) Foreign Application Priority Data

Aug. 28, 2002 (TW) ..... 91213390 U

(51) Int. Cl.[7] ..... H01R 12/00
(52) U.S. Cl. ..... 439/71; 439/862
(58) Field of Search ..... 439/66, 70, 71, 439/74, 862

(56) References Cited

U.S. PATENT DOCUMENTS 4,927,369 A 5/1990 Grabbe et al.
5,655,913 A 8/1997 Castaneda et al.
6,146,152 A 11/2000 McHugh et al.
6,164,980 A 12/2000 Goodwin
6,171,156 B1 * 1/2001 Lin et al. ..... 439/876
6,196,849 B1 3/2001 Goodwin

* cited by examiner

*Primary Examiner*—P. Austin Bradley
*Assistant Examiner*—X. Chung-Trans
(74) *Attorney, Agent, or Firm*—Wei Te Chung

(57) ABSTRACT

An electrical contact (30) received in a socket connector (1) for connecting a CPU (6) to a PCB (5) includes a retention plate (31) and a spring arm (33) and a connecting arm (32) connecting the spring arm to the retention plate. The retention plate engages with the socket connector for securely retaining the electrical contact in the socket connector. The spring arm includes a first curved arm (331) bent from the connecting arm toward the retention plate, a second curved arm (332) bent from the first curved arm opposite to the retention plate and a third curved arm (333) bent from the second curved arm toward the retention plate. The first curved arm has a bottom contacting end (330) for contacting with the PCB. Similarly, the third curved arm has a top contacting end (334) for contacting with the CPU.

5 Claims, 6 Drawing Sheets

ELECTRICAL CONTACT FOR LGA SOCKET CONNECTOR

BACKGROUND OF THE INVENTION

1. Field of the Invention

The present invention relates to an electrical contact, and particular to an electrical contact of a Land Grid Array (LGA) socket connector for securing a true electrical connection between a central process unit (CPU) and a printed circuit board (PCB).

2. Description of Related Art

In general, a LGA socket connector is used to connect a CPU to a PCB. Typically, the LGA socket connector includes an insulative housing and a plurality of electrical contacts received in the insulative housing. For example, U.S. Pat. Nos. 5,092,783, 5,746,626, 6,146,152, 6,217,342, and 6,257,899 disclose an LGA socket connector with a plurality of electrical contacts received therein. Each of the electrical contacts comprises a top curved contacting portion extending beyond an upper surface of the LGA socket connector and a bottom curved contacting portion extending beyond a lower surface of the LGA socket connector. When a CPU and a PCB are assembled to the socket connector, the top and bottom contacting portions are pressed inwardly into the insulative housing and establish an electrical connection between the CPU and the LGA socket connector.

Further referring to FIGS. 3–5 of U.S. Pat. No. 6,217,342, an electrical contact (14) comprising an arcuate convex spring (36) with a pair of opposite spring arms (44) and a pair of opposite noses (38) at ends of the spring (36), and a pair of retention legs (40) extending inwardly from the noses (38). When circuit members (46, 48) move toward each other, the noses (38) are pressed inwardly. The spring arms (44) move inwardly and sideward, thus, a mating force between the electrical contact (14) and the circuit members (46, 48) includes a vertical component force and a horizontal component force. As the circuit members (46, 48) move further toward each other, the vertical component force and the horizontal component force both increase. However, the horizontal component force is larger and increases faster than the vertical component force. In general, the vertical component force is not enough to secure a true electrical connection between the noses (38) and the circuit members (46, 48). While there is a large vibration, an electrical connection between the contact and the circuit members (46, 48) may be temporally interrupted. In addition, as the horizontal component force varies fast and a varied force may be larger than a frictional force between the nose (38) and pads (50, 52) of the circuit members (46, 48). Therefore, even a slight vibration may produce a horizontal scrubbed movement between the pads (50, 52) and the nose (38), and such affects the electrical connection between the electrical contact (14) and the circuit members (46, 48).

Hence, an electrical contact capable of providing a true electrical connection between external circuit members is desired.

SUMMARY OF THE INVENTION

Accordingly, an object of the present invention is to provide electrical contacts for an LGA socket connector which is capable of providing a true electrical connection between a CPU and a PCB.

In order to achieve the object set forth, an electrical contact received in a socket connector for connecting a CPU to a PCB includes a retention plate, a spring arm and a connecting arm connecting the spring arm to the retention plate. The retention plate engages with the socket connector for securely retaining the electrical contact in the socket connector. The spring arm includes a first curved arm bent from the connecting arm toward the retention plate, a second curved arm bent from the first spring arm opposite to the retention plate and a third curved arm bent from the second spring arm toward the retention plate. The first curved arm has a bottom contacting end for contacting with the PCB. Similarly, the third curved arm has a top contacting end for contacting with the CPU. While the socket connector is fully sandwiched between the CPU and the PCB, the first spring arm and the second spring arm deform opposite to each other whereby the top and bottom contacting ends move in a substantially vertical direction. Such establishes a true electrical connection between the CPU and the PCB.

Other objects, advantages and novel features of the invention will become more apparent from the following detailed description of the preferred embodiment when taken in conjunction with the accompanying drawings.

DETAILED DESCRIPTION OF THE INVENTION

Figure 1:
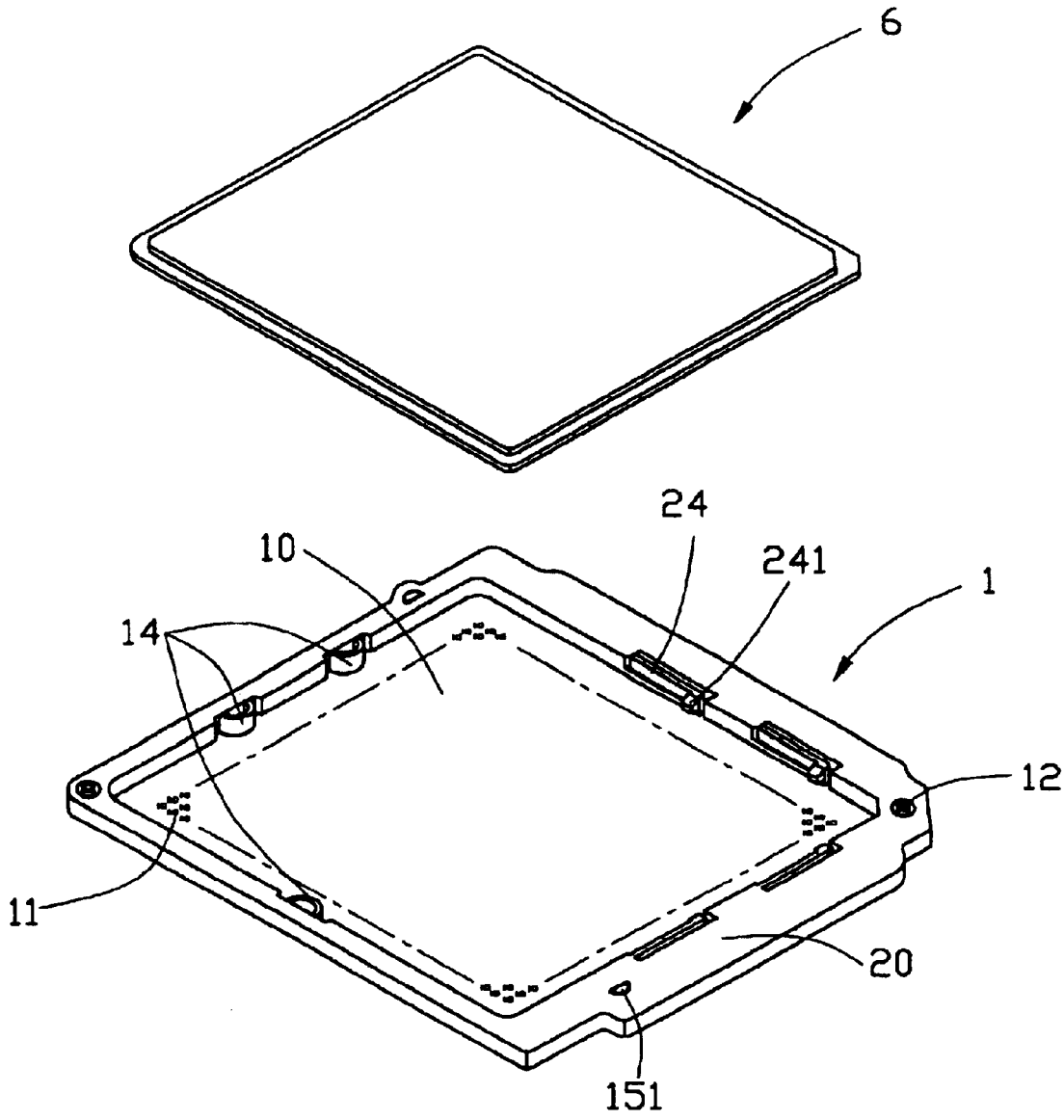
FIG. 1 is a perspective view of an assembled socket connector and a mating CPU in accordance with the present invention.

Reference will now be made to the drawing figures to describe the present invention in detail.

Figure 2:
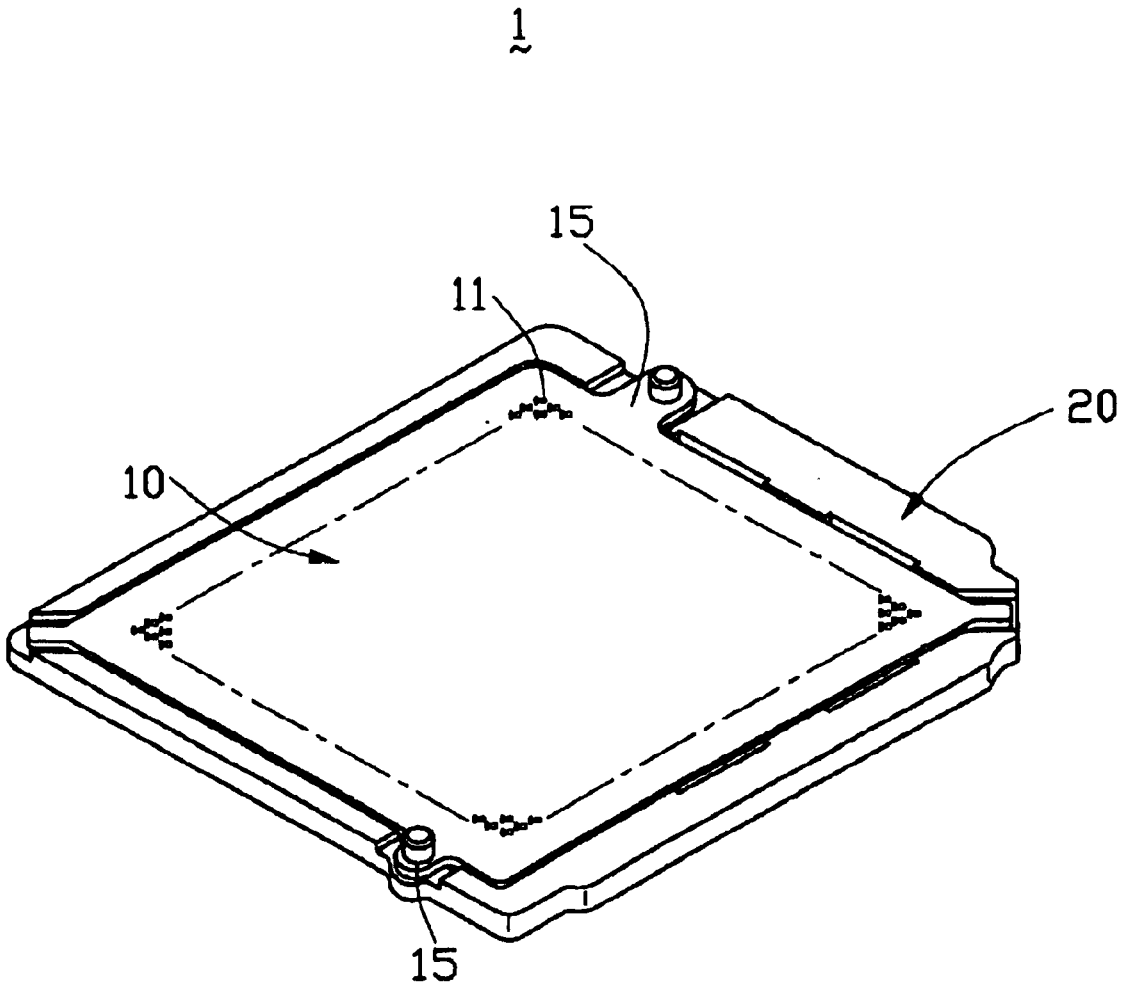
FIG. 2 is a bottom, perspective view of the assembled socket connector in FIG. 1 wherein the socket connector is rotated about a diagonal of the socket connector.
Figure 3:
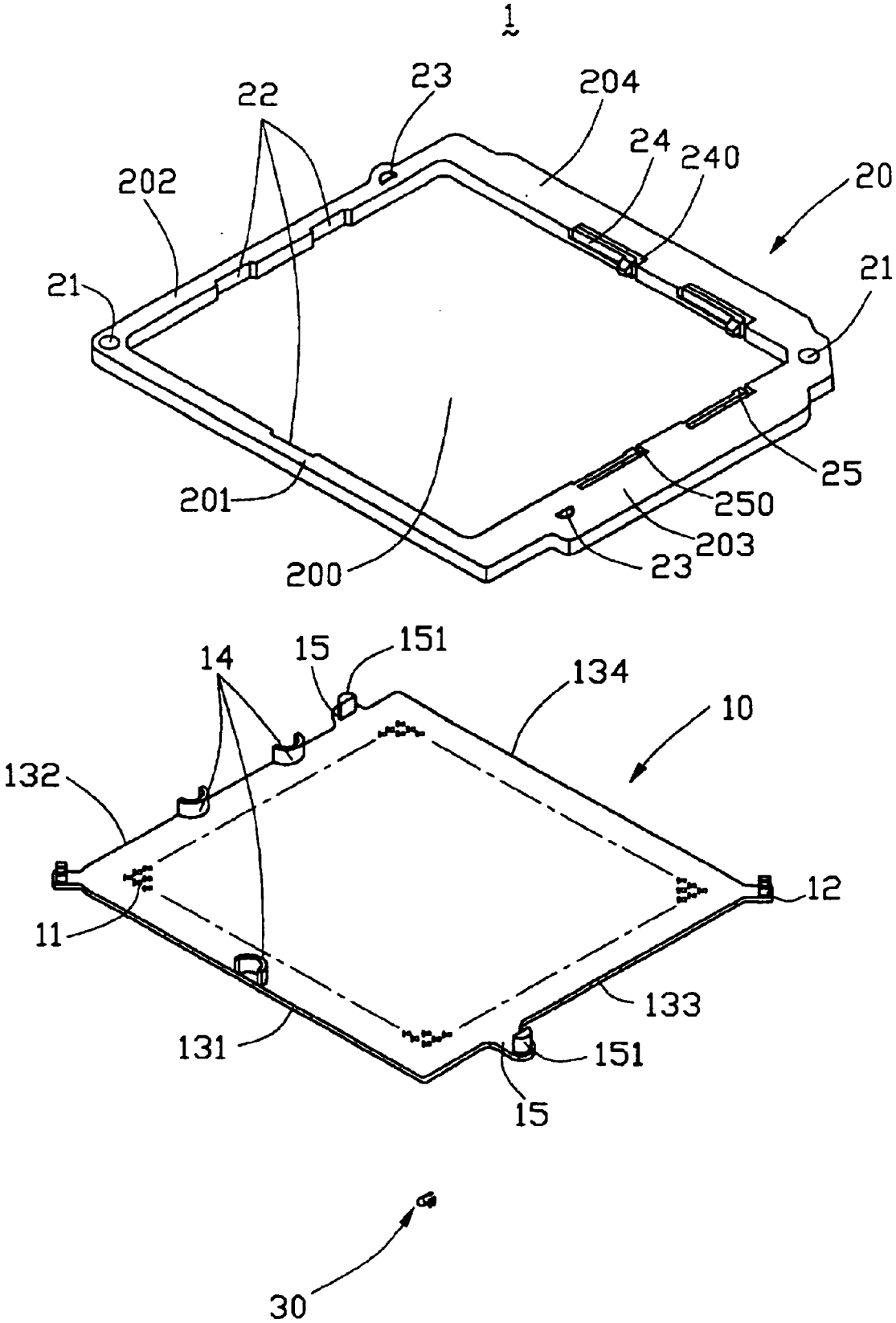
FIG. 3 is an exploded, perspective view of the socket connector in FIG. 1.

Referring to FIGS. 1–3, an LGA connector 1 of the present invention mountable on a PCB 5 is provided for electrically engaging with a CPU 6 thereby establishing an electrical connection between the CPU 6 and the PCB 5. The LGA connector 1 includes an insulative housing 2 and a plurality of electrical contacts 30 received in the insulative housing 2.

Figure 5:
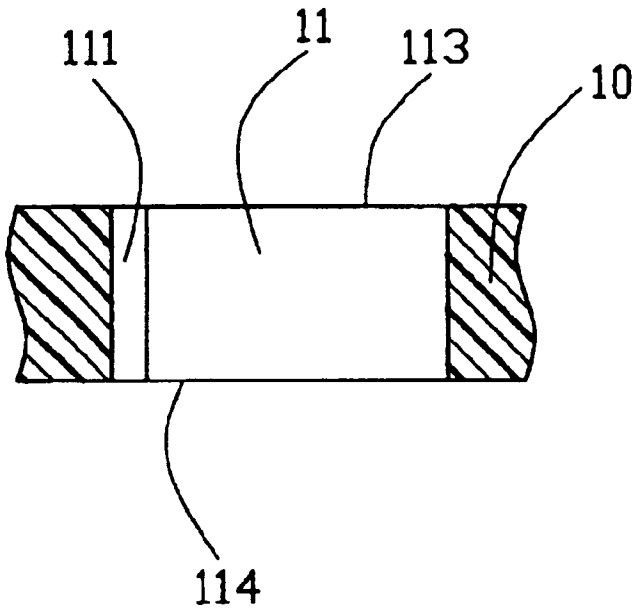
FIG. 5 is a cross-sectional view along line 5—5 in FIG. 4.
Figure 4:
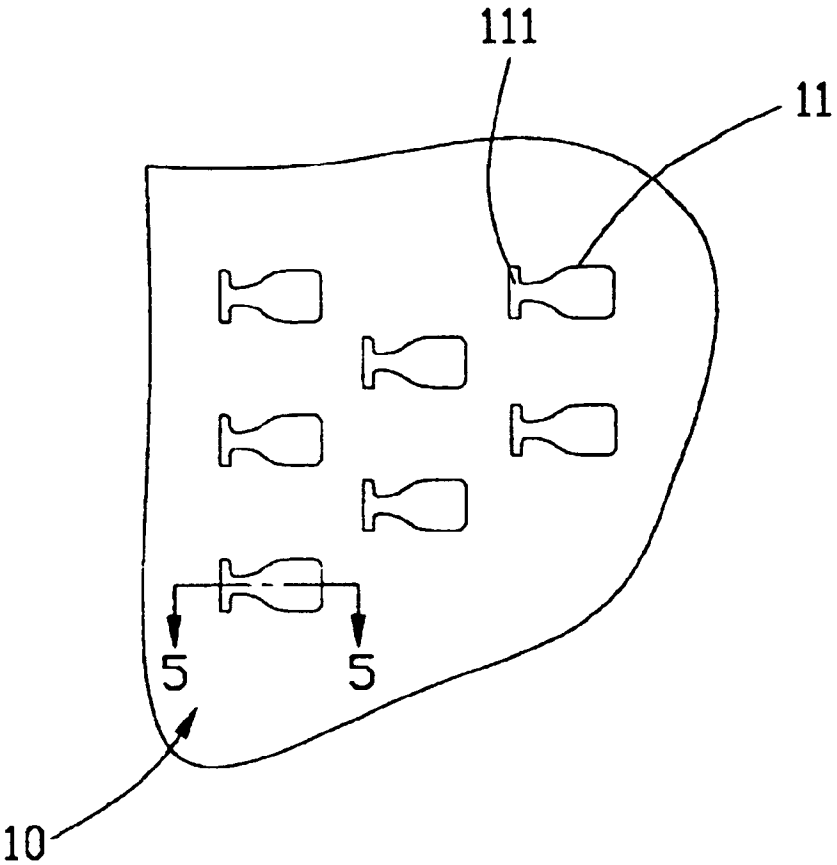
FIG. 4 is an enlarged, bottom view of the base in FIG. 1, showing a number of receiving cavities.

In conjunction with FIGS. 4 and 5, the insulative housing 10 includes a base member 10 and a rectangular frame 20 around the base member 10. The base member 10 is molded from plastic and has a rectangular shape with four edges 131, 132, 133, 134 around. The base member 10 defines a plurality of through receiving cavities 11 for receiving corresponding contacts 30 and a plurality of mounting slits 111 communicating with corresponding receiving cavities 11. A pair of retention locks 12 extends upwardly from a pair of opposite diagonal corners of the base member 10. In addition, the base member 10 forms an upward extending semi-circular position cirque 14 adjacent to a central portion of the edge 131 and two upward extending semi-circular position cirques 14 adjacent to the edge 132. A pair of ears 15 extends outwardly from opposite edges 132, 133. Each of the ears 15 forms a hemi-columnar pillar 151 extending upwardly.

The rectangular frame 20 is also molded from plastic and includes four sides 201, 202, 203, 204 around, which define a receiving room 200 for accommodating the base member 10. The rectangular frame 20 defines a pair of circular holes 21 in two opposite diagonal corners thereof for receiving corresponding retention locks 12. The rectangular frame 20 further defines an indentation 22 in the side 201 and a pair of indentations 22 in the side 202 for receiving corresponding position cirques 14. A pair of semi-circular holes 23 is defined in the sides 202, 203 for receiving corresponding hemi-columnar pillars 151. In addition, two first resilient arms 24 are formed in the side 204 and capable of deformation in a first space 240 defined in the side 204. Two second resilient arms 25 are formed in the side 203 adjacent to the side 204. The second resilient arm 25 is also capable of deformation in a second space 250 defined in the side 204. The first and second resilient arms 24, 25 are used to press edges of the CPU 6 in perpendicular directions on a horizontal plane for securing a true position of the CPU 6.

Figure 6:
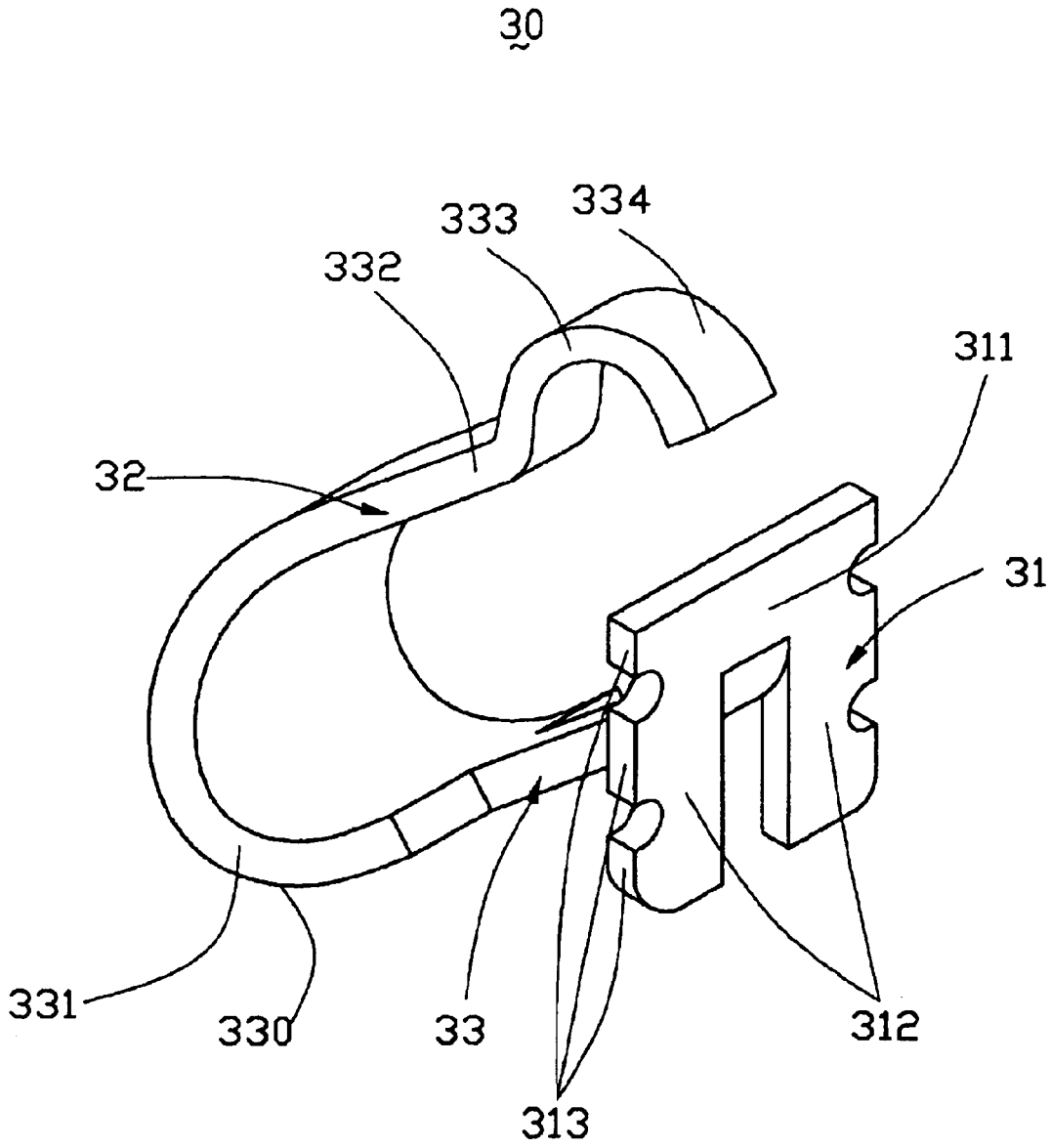
FIG. 6 is an enlarged, perspective view of a terminal in FIG. 3.

Referring to FIG. 6, each of the contacts 30 is punched from a raw metal plate and includes a retention plate 31, a curved spring arm 32 and a thinner connecting arm 33 connecting the spring arm 32 to the retaining plate 31. The retention plate 31 has a substantial n-shape and comprises a top horizontal beam 311 and a pair of vertical beams 312 extending downwardly from lateral edges of the horizontal beam 311. Each of the vertical beams 312 forms a plurality of barbs 313 at an outer edge thereof. The connecting arm 33 is bent from the retention plate 31 on air-bend die. The spring arm 32 includes a first curved arm 331 bent from the connecting arm 33 toward the retention plate 31, a second curved arm 332 bent from the first curved arm 331 opposite to the retention plate 31 and a third curved arm 333 bent from the second curved arm 332 toward the retention plate 31. The first curved arm 331 has a bottom curved contacting end 330 for contacting with a corresponding contacting pad 51 of the PCB 5. Similarly, the third curved arm 333 has a top curved contacting end 334 for contacting with a corresponding contacting pad 61 of the CPU 6.

In assembly, the electrical contacts 30 are assembled into the base member 10 with the retention plates 31 received in corresponding mounting slits 111 and the spring arms 33 received in corresponding receiving cavities 11. The barbs 313 engage with corresponding sidewalls around the mounting slits 111 for securely retaining the electrical contacts 30 in true positions in the base member 10. Successively, the rectangular frame 20 is mounted on the base member 10 with the hemi-columnar pillars 151 received in corresponding semi-circular holes 23 and the position cirques 14 received in corresponding indentions 22. The retention locks 12 are received in corresponding circular holes 21 and lock the rectangular frame 20 to prevent the base member 10 from move downwardly.

Figure 7:
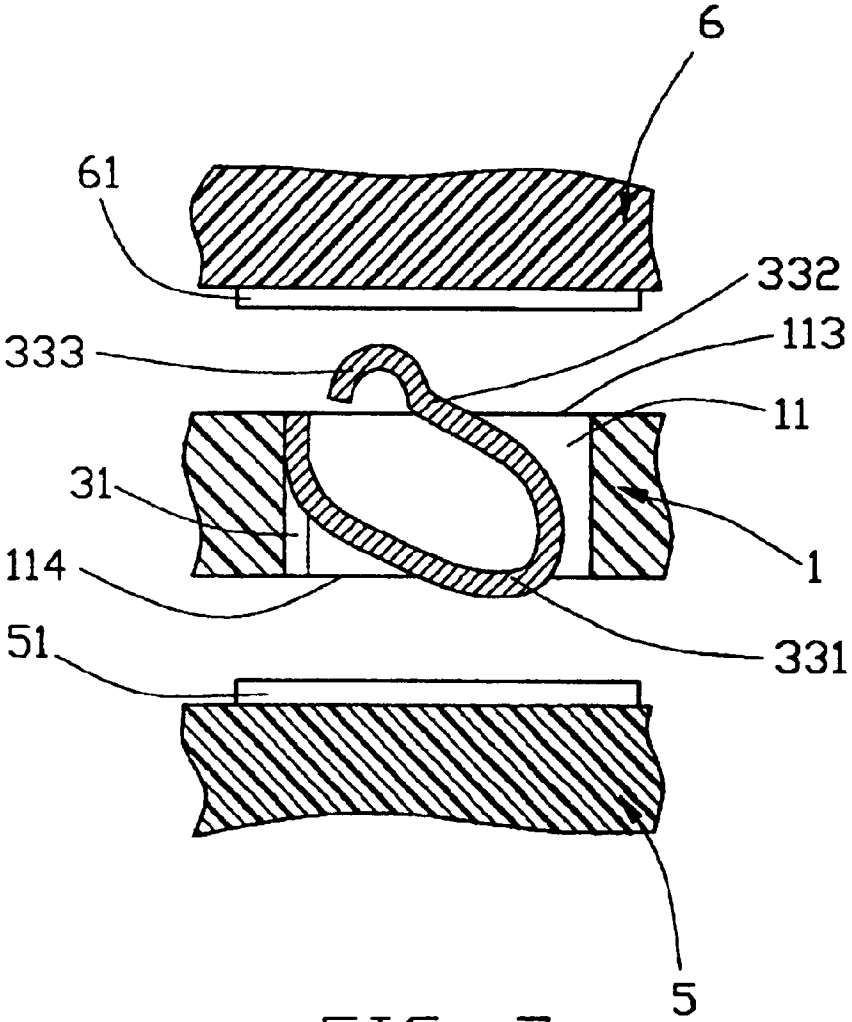
FIG. 7 is a cross-sectional view illustrating the position of the socket connector between the CPU and a PCB.

FIG. 7 illustrates the LGA socket connector 1 positioned between the CPU 6 and the PCB 5. The contacting pads 51, 61 of the PCB 5 and the CPU 6 locate above and below the electrical contacts 30.

Figure 8:
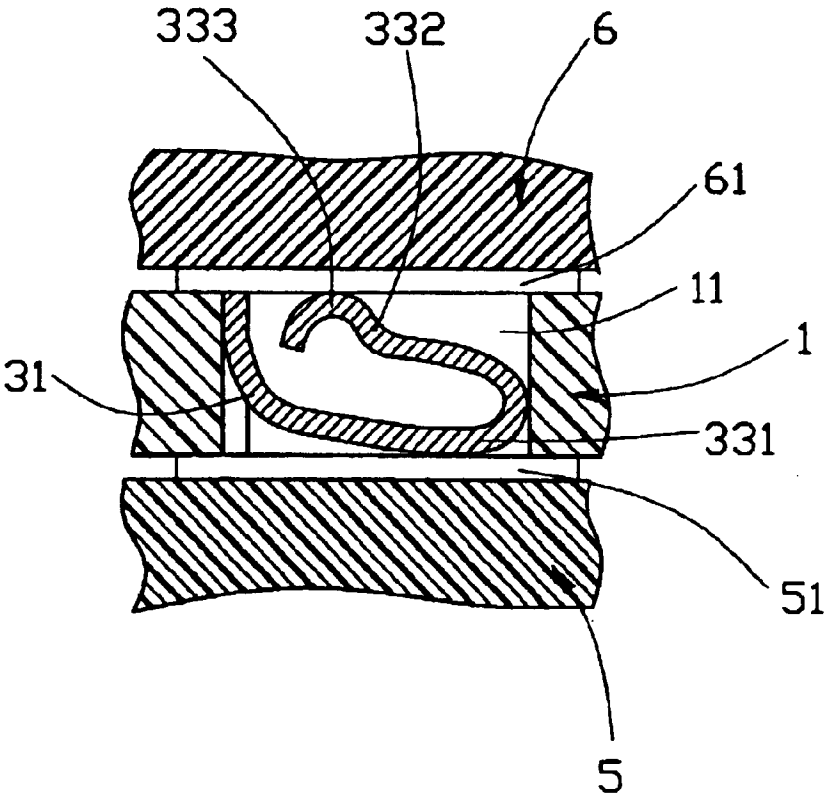
FIG. 8 is a view like FIG. 7 showing the socket connector sandwiched between the CPU and the PCB.

FIG. 8 illustrates the LGA socket connector 1 when fully sandwiched between the CPU 6 and the PCB 5 with the CPU 6 and PCB 5 held tightly against the LGA socket connector 1. While the PCB 5 and CPU 6 are brought into contact with the LGA socket connector 1, the top and bottom curved contacting ends 334, 330 respectively contact with the contacting pads 61, 51 of the CPU 6 and PCB 5, and reduce the height of the electrical contact to a minimum height and further elastically bend spring arm 32. Such establishes an electrical connection between the CPU 6 and the PCB 5. It should be noted that, while the CPU 6 is pressed downwardly, the top contacting end 334 of the electrical contact 30 remains a true connection with the contacting pad 61 of the CPU 6 and moves substantially in a vertical direction, because the first and second curved arms 331, 332 deform opposite to each other. The mating force between the contacting pad 61 of the CPU 6 and the top contacting end 334 also includes a vertical component force and a horizontal component force. However, the vertical component force is larger and varied faster than the vertical component force for a vertical movement of the top contacting end 334. Therefore, a vibration cannot produce a horizontal scrubbed movement between the pads 61 of the CPU 6 and the top contacting end 334. Such secures a true electrical connection between the electrical contact 30 and the CPU 6 and establishes a true electrical connection between the CPU 6 and the PCB 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket connector for connecting a CPU to a PCB, comprising:

an insulative housing comprising:

a base member defining a plurality of spaced receiving cavities and mounting slits communicating with corresponding receiving cavities; and a frame assembling around the base member; and a plurality of electrical contacts each comprising:

a retention plate received in a corresponding mounting slit; and a spring arm received in a corresponding receiving cavity and including a first curved arm extending downwards and slantsways from the retention plate, a second curved arm extending upwardly and slantways from a distal end of the first curved arm and face opposite to the first curve arm, and a third arm extending from a distal end of the second curved arm toward the retention plate; wherein the third curved arm has a top contacting end for contacting the CPU and the first curved arm has a bottom contacting end for contacting the PCB; wherein the spring arm further comprises a thinner connecting arm punched from the retention plate and connecting the first curved arm to retention plate;

wherein the frame forms a plurality of resilient arms on adjacent sides thereof for securing a true position of the CPU;

wherein the base member forms a plurality of semi-circular circles and the frame defines a plurality of indentations for receiving corresponding semi-circular circles.

2. The socket connector as described in claim 1, wherein the retention plate comprises a horizontal beam and a pair of opposite vertical beams extending downwardly from lateral edges of the vertical beams.

3. The socket connector as described in claim 2, wherein the connecting arm is between the vertical beams.

4. The socket connector as described in claim 1, wherein the base member forms two hemi-columnar pillars on two opposite sides and the frame defines two semi-circular holes for receiving corresponding pillars.

5. The socket connector as described in claim 1, wherein the base member forms two retention locks at two diagonal corners and the frame defines two circular holes for receiving corresponding retention locks.

* * * * *